US007107716B1

(12) United States Patent
Liao

(10) Patent No.: US 7,107,716 B1
(45) Date of Patent: Sep. 19, 2006

(54) APPARATUS FOR QUICK ASSEMBLING AND DISASSEMBLING OF ACCESSORIES TO FIREARM

(75) Inventor: Yin-Hsi Liao, Taipei (TW)

(73) Assignee: Guay Guay Trading Co., Ltd., Sijhih (TW)

( * ) Notice: Subject to any disclaimer, the term of this patent is extended or adjusted under 35 U.S.C. 154(b) by 0 days.

(21) Appl. No.: 11/165,025

(22) Filed: Jun. 24, 2005

(51) Int. Cl.
*F41C 27/00* (2006.01)

(52) U.S. Cl. ..... 42/108; 42/124; 42/125; 42/127

(58) Field of Classification Search ..... 42/111–148
See application file for complete search history.

(56) References Cited

U.S. PATENT DOCUMENTS 5,155,915 A * 10/1992 Repa ..... 42/127
6,442,883 B1 * 9/2002 Waterman et al. ..... 42/124
6,637,144 B1 * 10/2003 Nelson et al. ..... 42/120

* cited by examiner

*Primary Examiner*—Stephen M. Johnson
*Assistant Examiner*—Gabriel J. Klein

(57) ABSTRACT

An apparatus for quick assembling and disassembling of accessories to a firearm includes a mounting body that enables efficient switching of tactic equipments as accessories to the firearm and a mounting base stabilizing the apparatus to the base of the firearm.

1 Claim, 8 Drawing Sheets

APPARATUS FOR QUICK ASSEMBLING AND DISASSEMBLING OF ACCESSORIES TO FIREARM

BACKGROUND OF THE INVENTION (a) Field of the Invention

The invention relates to an apparatus for quick assembling and disassembling accessories to a firearm, and more particularly pertains to an apparatus comprising a mounting body and a mounting base; the apparatus enables quick assembling and disassembling of tactic equipments as accessories to a firearm, and the mounting base mounts the apparatus firmly on a base.

(b) Description of the Prior Art

As shown in FIG. 1, an apparatus A for assembling and disassembling of accessories to a firearm of prior art typically consists of a fixed position board A1, a fixed position screw A2, a buckling base A3 and a twisting button A4. The twisting button A4 on the buckling base A3 thereof buckles the apparatus A to a base of the firearm. The fixed position board A1 of the apparatus A assembles a tactic equipment to the apparatus A utilizing the fixed position screw A2; when the user is in motion, it is inconvenient and inefficient that the tactic equipment cannot be switched quickly.

Therefore, it is a vital task of the invention as how to avoid the disadvantage aforesaid.

SUMMARY OF THE INVENTION

The primary object of the invention is to provide an apparatus for quick assembling and disassembling of accessories to a firearm comprising gripping pieces to enable quick assembling and disassembling of tactic equipments to a firearm, and a mounting base to stabilize the apparatus on a base of the firearm.

A connecting rod goes through an aperture and connects a fine-tuning device with a locking switch. Furthermore, a screw thereof assembles the fine-tuning device to the apparatus. A spring-biased button wherein the locking switch on the other side of the connecting rod is bonded to the locking switch by a pin, and the angle or direction of the apparatus may be changed thereby when the user is in motion.

The apparatus for quick assembling and disassembling of accessories for a firearm enhances the function of the firearm by enabling quick switching of accessories such as a sniperscope, an eyepiece, a red dot sight, and . . . etc.

To emphasize novelty and practicability of the invention, the prior art and the invention are analyzed as below:

DISADVANTAGES OF THE PRIOR ART

1. Unable to assemble and disassemble accessories to a firearm efficiently.
2. May cause the accessories loosen up or falling off after long-term usage.
3. Require tools to disassemble which is complicated and time-consuming.

ADVANTAGES OF THE INVENTION

1. Mounting base prevents accessories from loosen up or falling off.
2. The apparatus is efficient in switching accessories of a firearm.
3. The apparatus is suitable for firearms in any angle or direction.

4. The apparatus offers novelty and practicability.
5. The apparatus increases industrial competitiveness.

To better understand characteristics, effects and functions of the invention, detailed descriptions of a preferred embodiment shall be given with the accompanying drawings below.

DETAILED DESCRIPTION OF THE PREFERRED EMBODIMENTS

Figure 1:
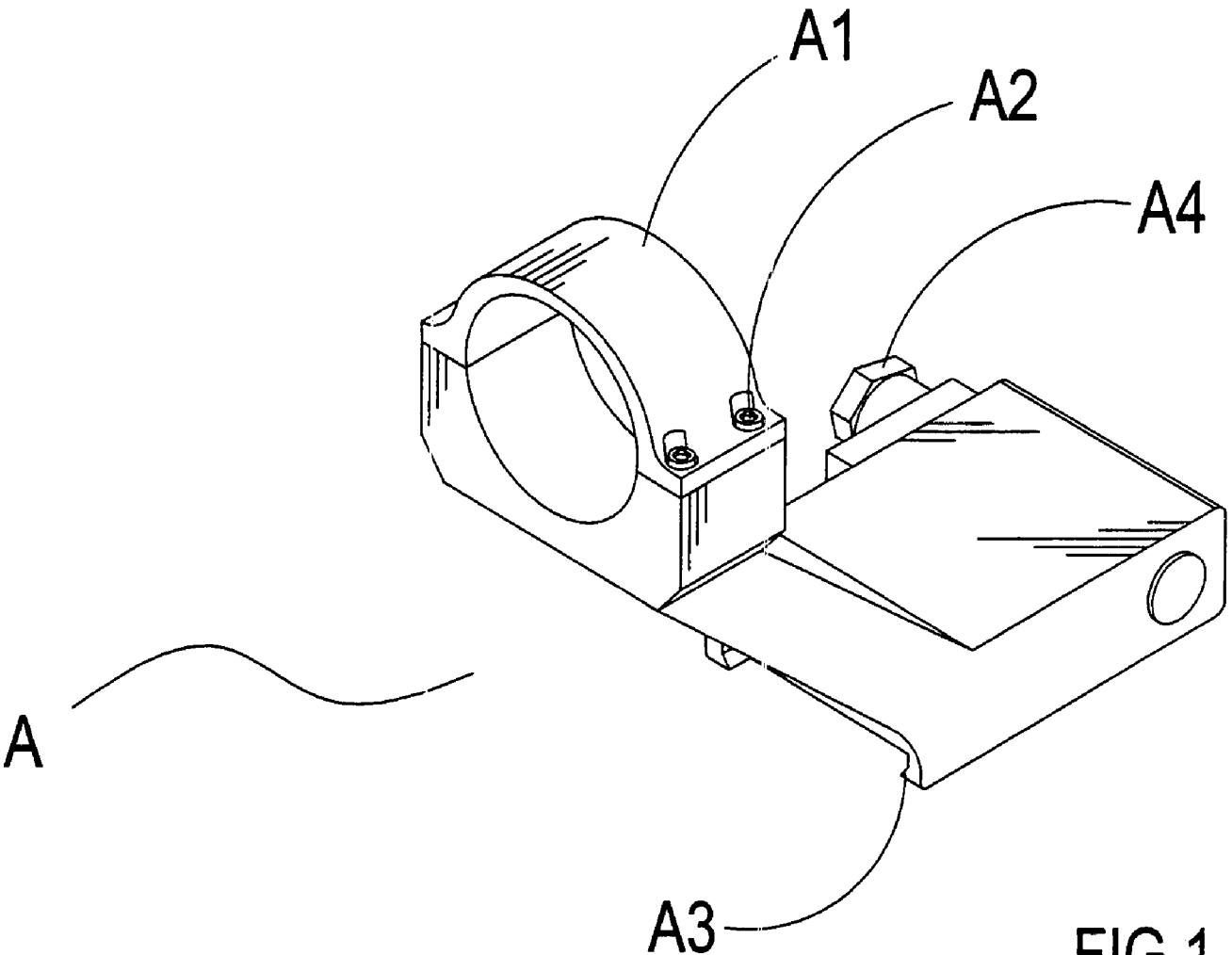
FIG.1 Prior Art
FIG. 1 shows an elevational view according to the prior art.
Figure 2:
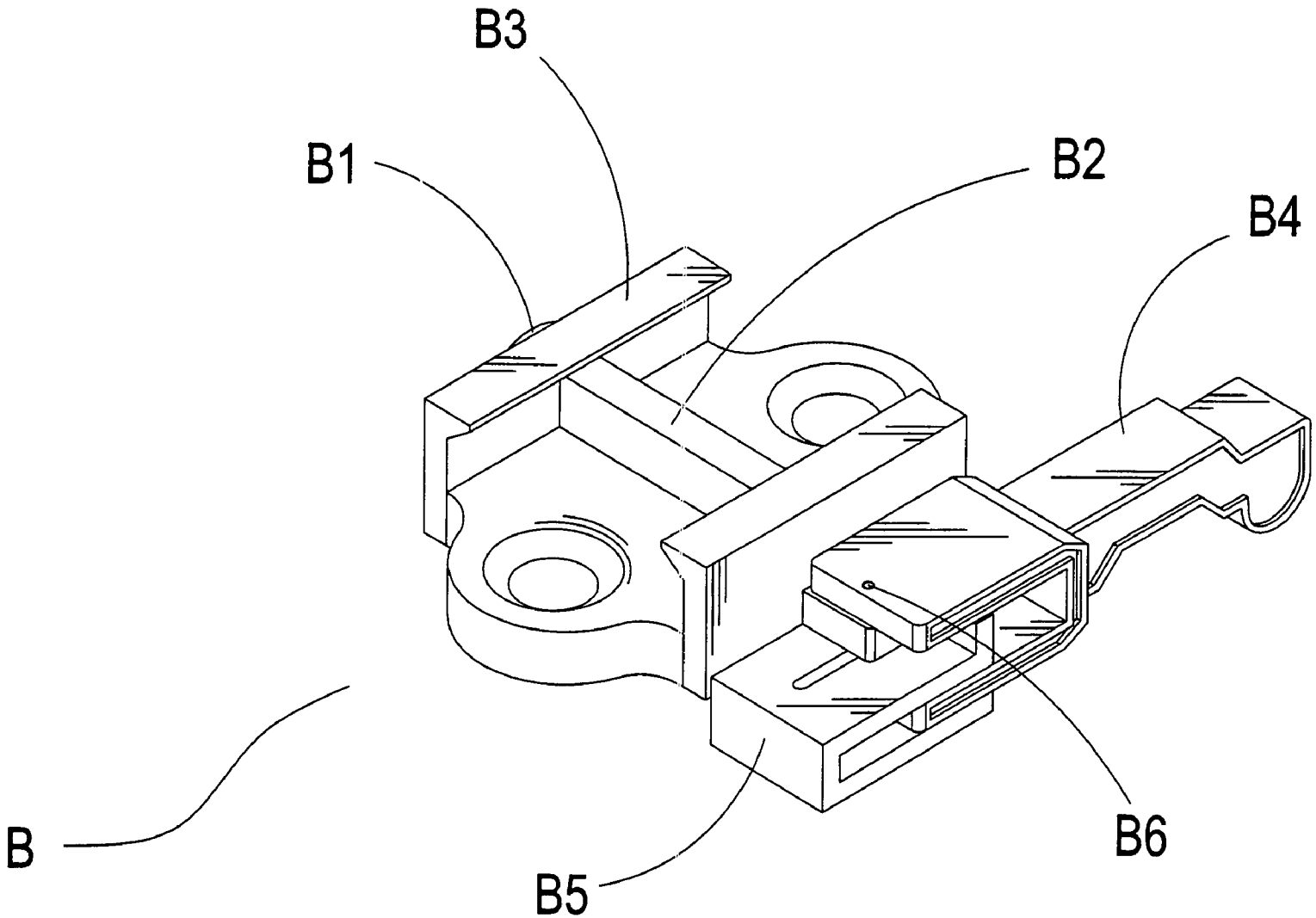
FIG. 2 shows an elevational view according to the invention.
Figure 3:
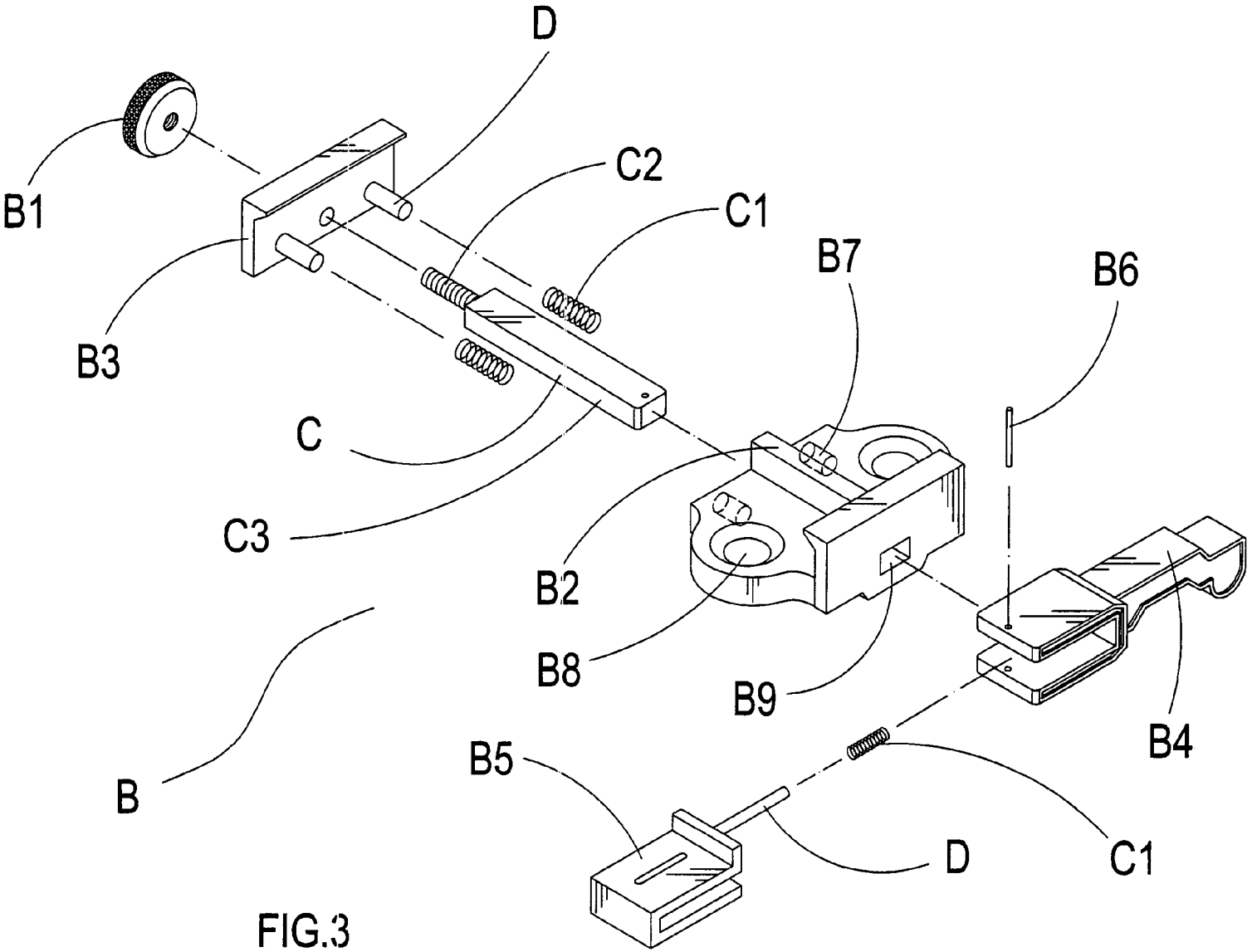
FIG. 3 shows exploded elevational view according to the invention.

According to FIG. 2, an apparatus B for quick assembling and disassembling of accessories to a firearm is consisted of a fine adjustment device B1, a mounting base B2, gripping pieces B3, a locking switch B4, a spring-biased button B5, and a pin B6. Referring to FIG. 3, the apparatus B comprising spring apertures B7 and springs C1 therein to adjust degree of tightness between the apparatus B and a base E of a firearm in coordination with protruding pillars D and the fine-tuning device B1 of the gripping pieces B3. A connecting rod C goes through an aperture B9 in the mounting base B2 and connects the locking switch B4 and the elastic film B5 thereafter. A screw aperture B8 enables quick switching of the tactic equipment F (shown in FIG. 7 & FIG. 8) when the apparatus B is buckled to the base E of the firearm.

The fine-tuning device B1 is assembled to the apparatus B by a screw C2 at the front end of the connecting rod C; it adjusts the degree of tightness between the apparatus B and the base E. A fixed position aperture C3 at the back end of the connecting rod C bonds the locking switch B4 and the elastic film B5 together by a pin B6; when the elastic film B5 consisted of another spring C1 in another protruding pillar D is pressed inward, the position of the apparatus B may be adjusted. After the apparatus B is adjusted to the desired position and assembled to the base E of the firearm, adjusting the fine-tuning device B1 stabilizes the apparatus B more firmly.

Figure 4:
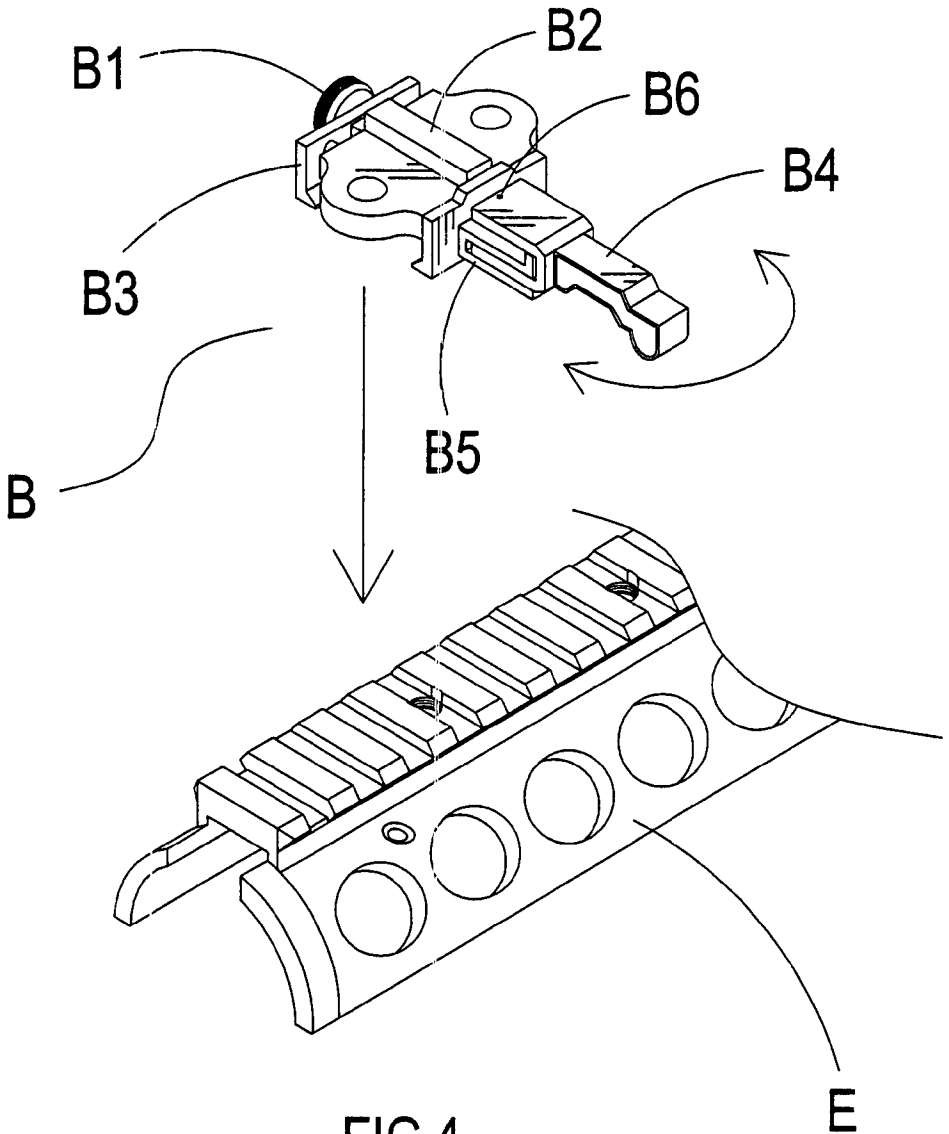
FIG. 4 shows a schematic view illustrating motions of an embodiment according to the invention.
Figure 5:
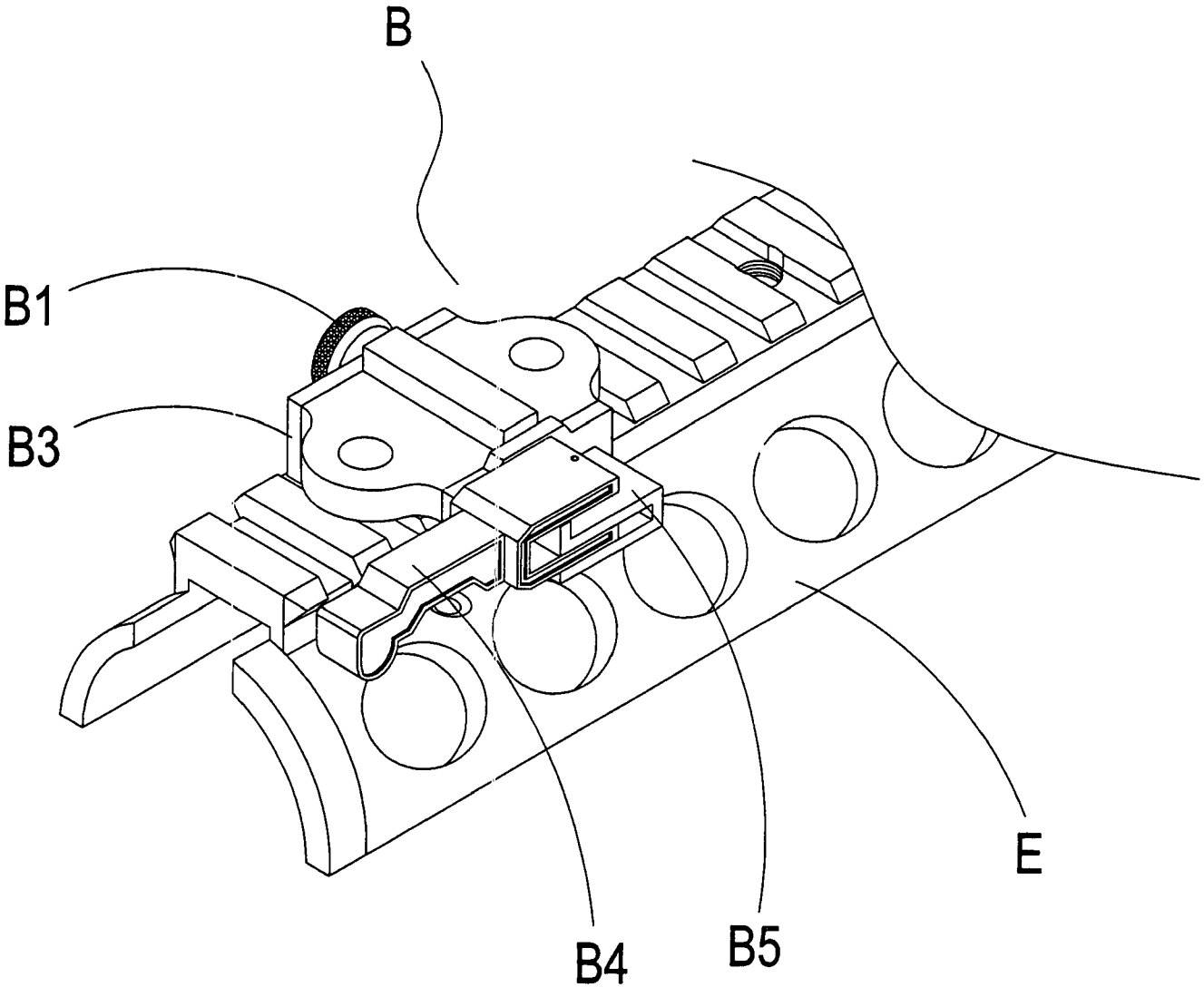
FIG. 5 another schematic view illustrating motions of an embodiment according to the invention.
Figure 6:
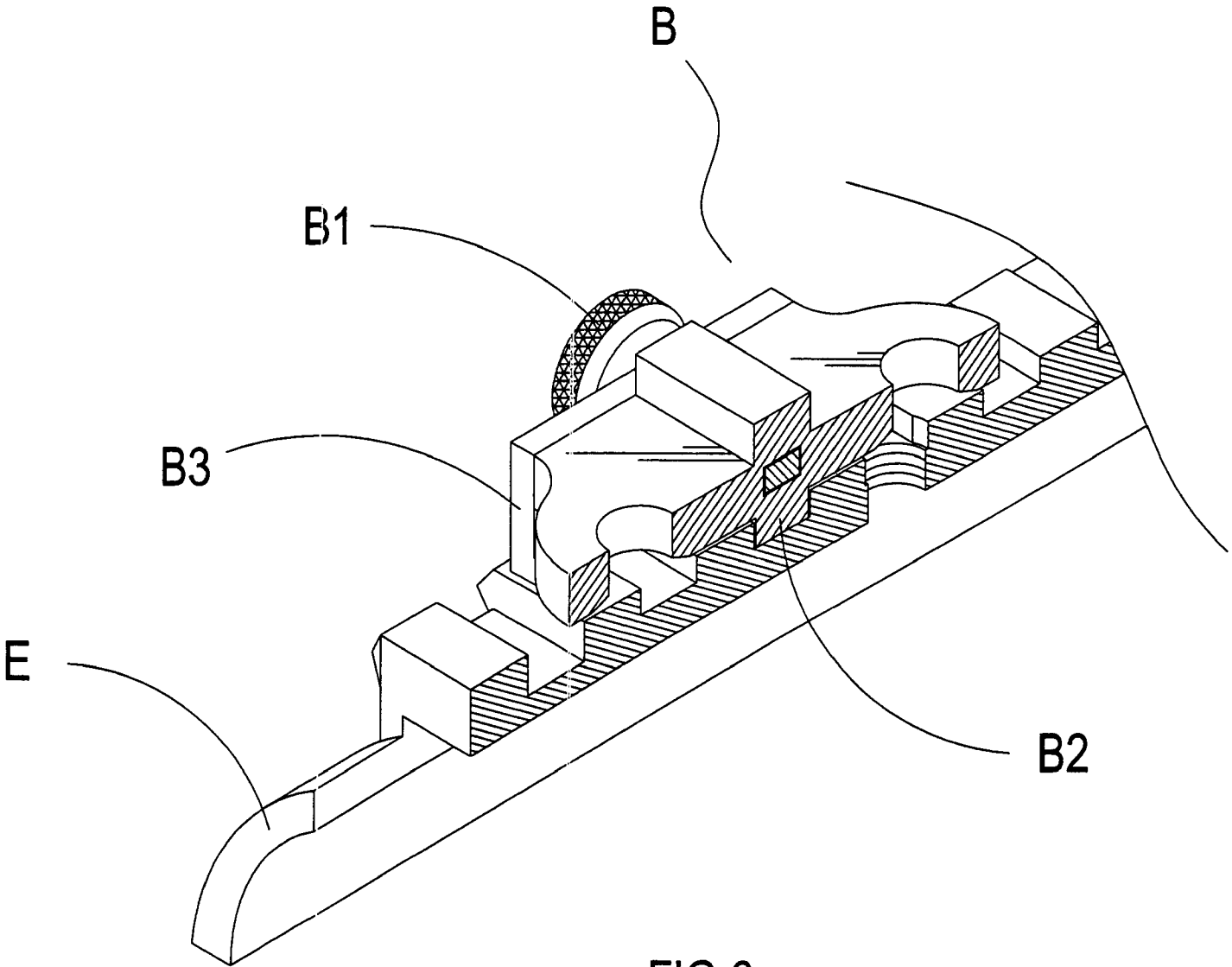
FIG. 6 shows a partial sectional view according to the invention.

Motions of the embodiments according to the invention are shown in FIG. 4, FIG. 5 and FIG. 6. When assembling an apparatus B to a base E of a firearm utilizing a locking switch B4, a fine-tug device B1 and a mounting base B2, the locking switch B4 is perpendicular to the base E. To utilize the locking switch B4 lock the apparatus B in the desired position, the mounting base B2 must be mounted into the desired position of the base E and the elastic film B5 which locks the direction of the locking switch B4 must be pressed inward. A fine-tuning device B1 adjust degree of tightness of the gripping pieces B3 to ensure that the apparatus B and the base E fit tightly.

Figure 7:
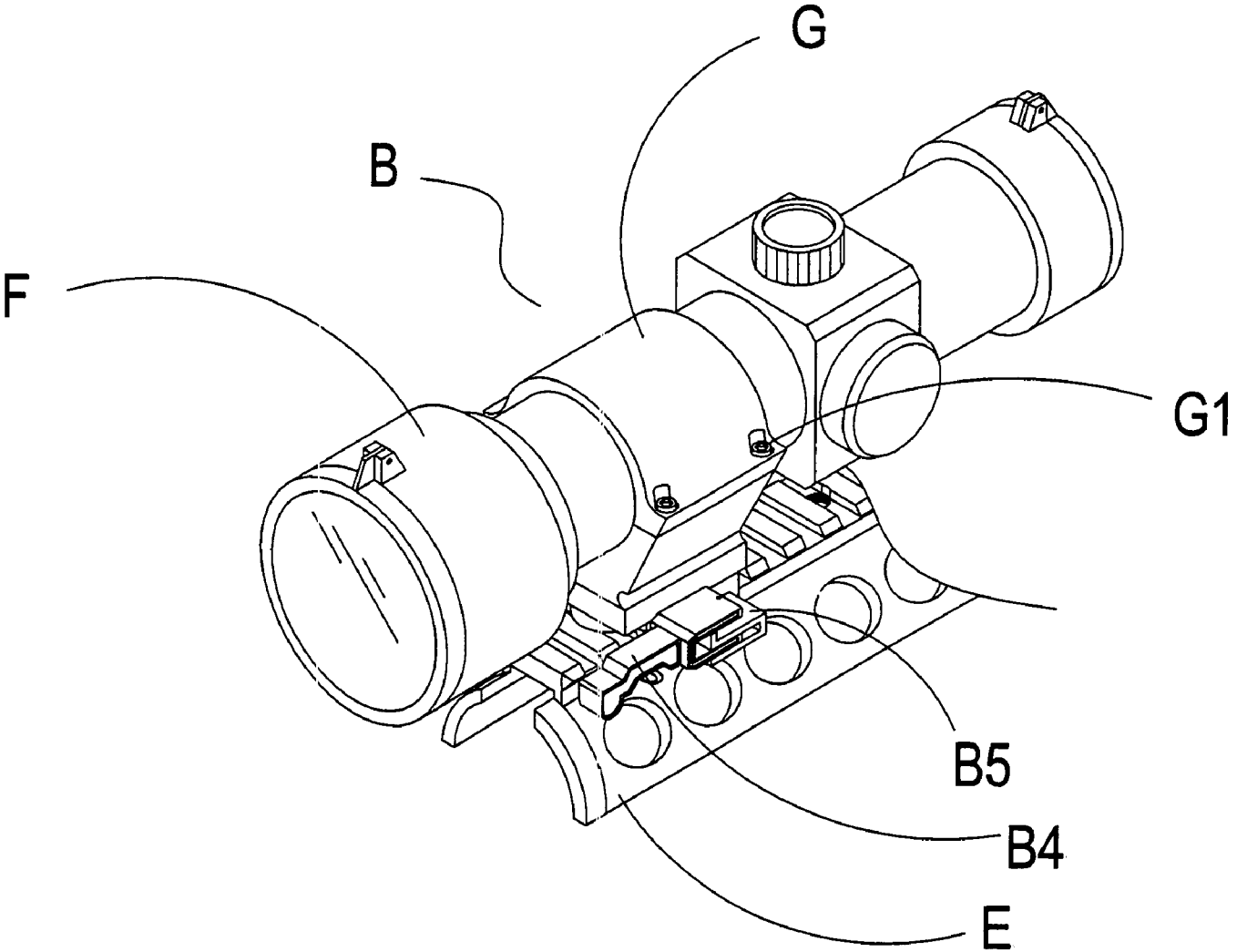
FIG. 7 shows a schematic view of embodiment according to the invention.

As shown in FIG. 7, to install different types of a tactic equipment F onto an apparatus B conveniently, a fixed position ring G is added to the tactic equipment F and assembled to the apparatus B by a screw G1 thereafter. After the apparatus B is assembled to the base E, a locking switch B4 thereof latches. The direction and angle of the apparatus B can be changed and stabilized conveniently by pressing the elastic film B5 inward and unlock the locking switch B4 thereafter to reduce processing time of changing tactic equipment F while the user is in motion.

Figure 8:
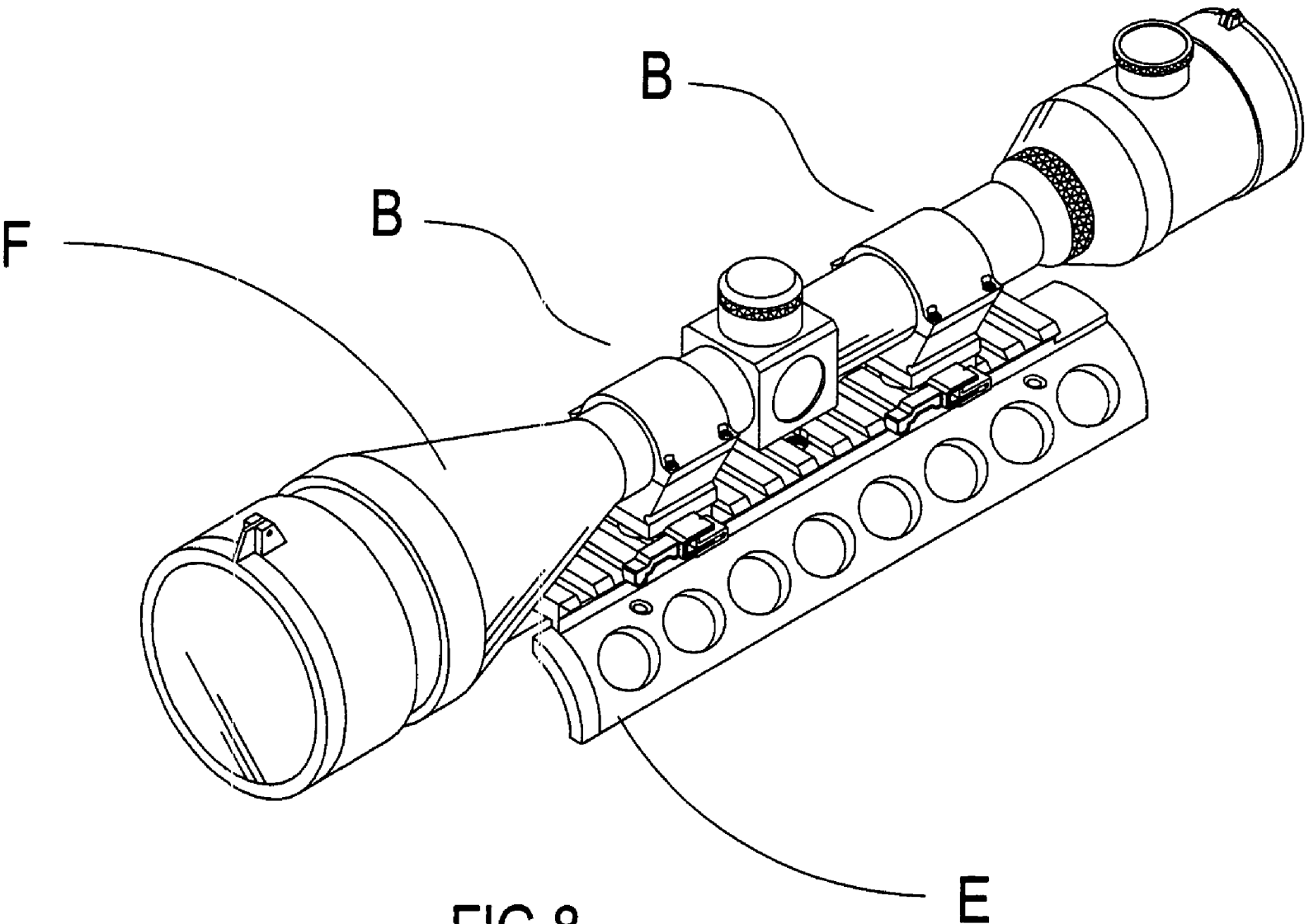
FIG. 8 shows a schematic view of another embodiment according to the invention.

As shown in FIG. 8, a tactic equipment F of different length can be installed to a base E by an apparatus B. Furthermore, another apparatus B may be added to operate in coordination with a longer tactic equipment F to fulfill different demands of the user.

The apparatus B can be installed to the right or left side of a firearm with the base E to assemble the tactic equipment F in different lengths to the firearm.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An apparatus for quick assembling and disassembling of accessories to a firearm comprising:

a mounting base with an aperture therein mounting into a position on a base of a firearm, a screw aperture located on the mounting base stabilizing extra tactic equipment, a connecting rod going through the aperture of the mounting base, linking a locking switch and spring-biased button and enabling quick switching of tactic equipments comprising a screw at the front end and a fixed position aperture at the back end, a fine-tuning device that is assembled to the connecting rod by the screw adjusting the degree of tightness between the apparatus and the base of the firearm, said spring biased button enabling the direction and position of the apparatus to be changed when pressed inward, a locking switch keeping the apparatus in a position on the base of said firearm, and a pin attaching the locking switch and the spring biased button through the fixed position aperture of the connecting rod.

* * * * *